United States Patent [19]

Akashi

[11] 4,323,891

[45] Apr. 6, 1982

[54] CURSOR DISPLAY CONTROL SYSTEM FOR A RASTER SCAN TYPE DISPLAY SYSTEM

[75] Inventor: Kazuo Akashi, Ome, Japan

[73] Assignee: Tokyo Shibaura Denki Kabushiki Kaisha, Kawasaki, Japan

[21] Appl. No.: 143,798

[22] Filed: Apr. 25, 1980

[30] Foreign Application Priority Data

Apr. 27, 1979 [JP] Japan ..... 54-51441

[51] Int. Cl.[3] ..... G09G 1/16

[52] U.S. Cl. ..... 340/709; 340/717; 340/750; 340/800

[58] Field of Search ..... 340/705, 709, 717, 744, 340/750, 800

[56] References Cited

U.S. PATENT DOCUMENTS 3,792,198 2/1974 Hanson et al. .

4,112,423 9/1978 Bertolasi ..... 340/717 X

FOREIGN PATENT DOCUMENTS 51-45211 12/1976 Japan .

*Primary Examiner*—David L. Trafton

*Attorney, Agent, or Firm*—Kenyon & Kenyon

[57] ABSTRACT

In a raster scan type display system in which a display screen is divided into a plurality of sections, and the display information is supplied to stations by using a mirror reflection, a cursor address for one of the divided sections or screens is outputted from an interface controller while the cursor address for the other divided screen is stored in a register in the controller. The cursor address produced by the interface controller is compared with the refresh memory address outputted from a CRT controller in a comparator. When both are coincident with each other, the comparator produces a cursor display signal.

7 Claims, 14 Drawing Figures

CURSOR DISPLAY CONTROL SYSTEM FOR A RASTER SCAN TYPE DISPLAY SYSTEM

BACKGROUND OF THE INVENTION

The present invention relates to a display system and, more particularly, to a display system of the type in which a screen of a display system of the raster scan type is divided into a plurality of sections or screens and the display information on the divided screen is supplied to respective stations by using mirror reflection.

In place of the conventional card punch system, a key to FDD (floppy disk drive) using a floppy disc as a recording medium has been used widely. The key to the FDD will be referred to as a data system. A data system of this type allowing two operators to work individually has an increasing market because of its good cost/performance ratio. The two-operator data system will be called a multiple data system. Most multiple data system are of the type using a single display unit. More particularly, a single screen is divided into two screen or sections for displaying independently the display information. A mirror used in combination with the divided screen reflects the display information on the divided screen toward two operators. In a multiple data system having the above display unit, although a single display unit may be used, the display controller hardware can not simply be reduced to half of that for two display units, especially since, one cursor signal is necessary for each respective operator. Accordingly, the number of parts used in the cursor control circuit increases, thereby making the circuit complicated and its costs high.

OBJECTS AND SUMMARY OF THE INVENTION

Accordingly, an object of the invention is to provide a cursor display system capable of displaying cursors at different positions on the display surface of two stations.

To achieve the above object, there is provided a cursor display control system for a raster scan type display system which divides a raster scan type display screen and provides the display information to the respective sides by using a mirror reflection comprising, a displaying unit for display dot data in a raster scan manner, a programmable CRT controller for interfacing the display unit of the raster scan type and for producing a refresh memory address, a raster address and a timing signal for displaying data on the display screen in order that the screen can be programmably set;

a refresh memory for storing coded data to be displayed in response to the refresh memory address obtained from the controller;

raster address converting circuit means which receives the raster address obtained from the controller and converts the raster address to a converted raster address;

multiplexer means for selectively outputting the raster address from said controller and the converted raster address from said raster address converting circuit means on the basis of control information the refresh memory address;

a character generator for converting the coded data inputted from said refresh memory into display pattern data on the basis of raster address information obtained from the multiplexer means;

bidirectional shift register means which receives the pattern information from the character generator, determines the shift direction on the basis of the control information contained in the refresh memory address, and produces serial dot data to the display unit;

cursor address information storing means for storing cursor address information supplied from a central processing element through a system bus;

comparing means which compares the cursor address information outputted from the cursor address information storage means with the refresh memory address outputted from the programmable CRT controller and produces a cursor display signal when both the information and the refresh memory address are coincident with each other.

BRIEF DESCRIPTION OF THE DRAWINGS

This invention can be more fully understood from the following detailed description when taken in conjunction with the accompanying drawings, in which.

DESCRIPTION OF THE PREFERRED EMBODIMENTS

Figure 1:
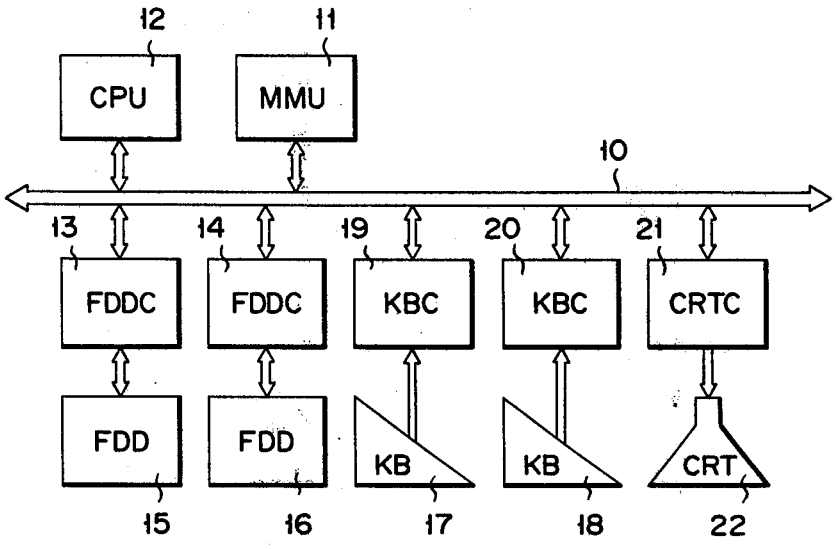
FIG. 1 is a block diagram of a multiple data system to which the invention is applied.

Referring now to FIG. 1, there is shown a multiple data system to which the invention is applied. In FIG. 1, a main memory unit (MMU) 11 connected to a system bus 10 including an address line, a data line and a control line is comprised of a read only memory and a random access memory and stores programs and data through the system line 10. A central processing unit (CPU) 12 connected to the system bus 10 performs arithmetic operation and the control of the entire system under control of the program stored in the MMU 11. Floppy disc controllers (FDD) 13 and 14 are connected to the system bus 10 and also to floppy disc units (FDU) 15 and 16. The FDUs 15 and 16 store the programs and data which are overflowed from the MMU 11. The keyboards (KB) 17 and 18 are connected through keyboard controllers (KBC) 19 and 20 to the system bus 10. The data keyed in by the KBs 17 and 18 is temporarily stored in the MMU 11 through the system bus 20 and then is displayed on the CRT 22 through the CRT controller 21 (CRTC). The CRTC 21 holds the display data of the CRT 22, performs the data conversion, and generates the synchronizing signal. The CRT 22 is so designed as to provide two picture screens corresponding to the stations. The FDD 15 and the KB 17 are assigned to the station 1 and the FDD 16 and the KB 18 are assigned to the station 2.

Figure 2:
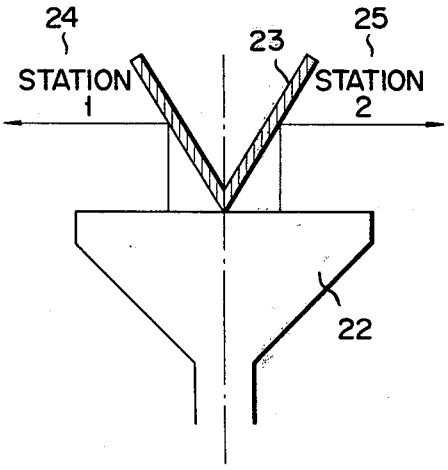
FIG. 2 is a diagram illustrating a single display unit having two screens sections or stations.
Figure 3:
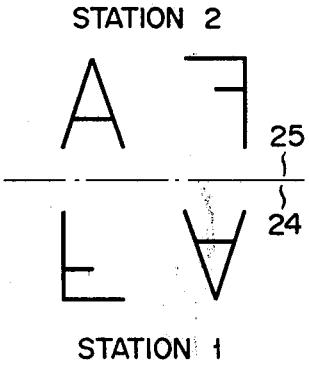
FIG. 3 is a display of the two characters "A" and "F" which are commonly displayed on the screens of the two stations.

FIG. 2 illustrates the principle of providing two displays by using a single picture screen. Pictures on the CRT 22 are reflected by a mirror 23 toward the operators at the stations #1 24 and #2 25. In this way, one picture screen is divided into two sections or screens and different information is supplied to the respective operators. Accordingly, when characters "F" and "A" are applied as the display data to the stations, the formats of the characters displayed on the CRT screen are as shown in FIG. 3 where the upper part above the central broken line is for station #2 25 and the lower part below the broken line is for station #1 24.

Figure 4:
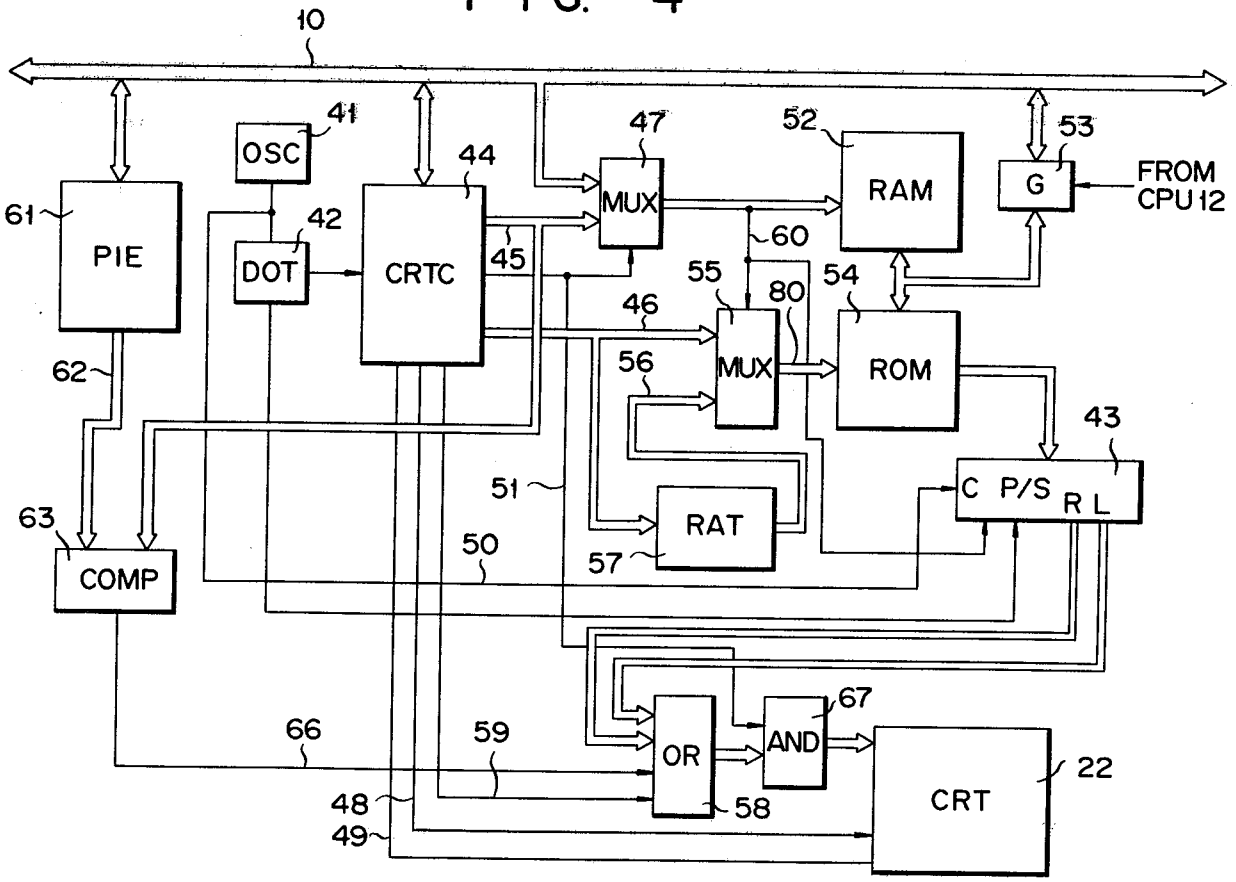
FIG. 4 is a block diagram of an embodiment of a cursor display system for a raster scan type display system according to the invention.

FIG. 4 is a hardware block diagram of an embodiment of a cursor control system according to the invention. In FIG. 4, an oscillator 41 produces a clock signal to provide dots which cooperatively form a symbol or characters on the CRT screen. A dot counter 42 is connected to the oscillator 41 to count the clock signal produced by the oscillator 41 and to produce the count data for each character display. The counter data outputted from dot counter 42 is supplied to a CRT controller 44 and a bidirectional shift register 43. The CRT controller 44 is connected to the system bus 10 and the dot counter 42. The CRT controller 44 is a controller for interfacing between the CPU 12 and the CRT 22 of the raster scan type. An HD 46505 (Programmable CRT Controller) of large scale integration (LSI) is applicable as the controller 44. The controller 44 is capable of controlling: the period of horizontal scanning, the period of vertical scanning for each line, the number of display characters for each line, the number of display lines of one picture, the number of rasters for each line, the display position in the horizontal direction on the CRT 22, the display position in the vertical direction on the CRT, the pulse width of a horizontal synchronizing signal, the cursor display position on the CRT 22, and the direction of an address to make an access to the refresh memory. Accordingly, the CRT controller 44 can programmably form a picture on the CRT 22 using the above items as parameters. The CRT controller 44 has four registers for signals to control the cursor. Those registers are: a cursor start raster register, a cursor end raster register, a cursor (H) register to store the high portion of the refresh memory address, and a cursor (L) register to store the low portion of the refresh memory address. If the capacity of the refresh memory is small, for example, 256 words/display, a parameter is set only in the cursor (L) register. In the cursor (H) register, all "ZEROs" should be set. In this case, however, the number of bits are 8 bits.

The controller 44 produces a horizontal synchronizing signal on line 48 and a vertical synchronizing signal on line 49 to transmission for the CRT 22. The controller 44 supplies a display timing signal on line 51 to a multiplexer 47 and an AND circuit 67. The cursor display signal is supplied to an OR circuit 58, on line 59. The refresh memory address is supplied on bus line 45 to the multiplexer 47 and a comparator 63. The raster address is supplied to a multiplexer 55 and a raster address converting circuit 57 on bus line 46. The multiplexer 47 receives an address from the system bus 10 and a refresh memory address signal for reading which is outputted from the CRT controller 44, and selectively produces either of those.

Of that address information inputted to the multiplexer 47, an address supplied through the system bus 10 is a write address used when display data is written into the refresh memory 52. The address inputted from the CRT controller 44 is a read out address for reading out the display data from the refresh memory 52. The refresh memory 52 is connected to the multiplexer 47 and is connected to the system bus 10 through a gate 53. The refresh memory 52 is comprised of a random access memory (RAM) and stores the display information of one picture, for example, 1024 characters. Address information inputted through the multiplexer 47 reads out coded data from the refresh memory 52 and applies it to a character generator 54. The gate 53 is a control gate for applying the display data coming through the system bus 10 to the refresh memory 52, in response to the write signal from the CPU 12. The character generator 54, which comprises a read only memory (ROM), is connected to the refresh memory 52 and a multiplexer 55. The character generator 54 converts the coded data into corresponding character information in response to the address information which is the combination of the display data and the raster address inputted from the CRTC 44 through the multiplexer 55. The multiplexer 55 connected to the CRT controller 44 is supplied with raster address converting information applied through a bus line 46 and a raster address through the bus line 56. The multiplexer 55 is supplied with the most significant bit information outputted from the multiplexer 47, on line 60. The same information is applied to the bidirectional shift register 43. When the most significant bit information of the address is a logical "0", the multiplexer 55 selects and produces the raster address through the bus line 46. When it is a logical "1", the multiplexer 55 selects and produces the raster address converting information. In the bidirectional shift register 43, when the most significant bit of the address is a logical "0", the display information is shifted to the right. When it is logical "1", the display information is shifted to the left. The raster address converting circuit 57 is comprised of an inverter and is connected to the CRT controller 44. The raster address converting circuit 57 inverts the raster address information supplied from the CRT controller 44 and the inverted raster address is supplied to the multiplexer 55.

The bidirectional shift register 43 is connected to the oscillator circuit 41, the dot counter 42, and the character generator 54. Having the output signal from the dot counter, the shift register 43 fetches the character pattern information from the character generator 54 and responds to the signal outputted from the oscillator circuit 41 to shift its contents to the right or to the left. The selection of a right shift or a left shift depends on the control signal (the most significant bit of the address information of the refresh memory 52) outputted from the multiplexer 47. When the most significant bit (MSB) is a logical "0", it is shifted to the right, for example, and when the MSB is a logical "1", it is shifted to the left. The inverse shift direction in this case is of course allowed, if necessary.

To the bidirectional shift register 43 is connected an OR circuit 58. The OR circuit 58 is supplied with a cursor display signal from the CRT controller 44.

The OR circuit 58 is connected to the AND circuit 67. The AND circuit 67 is supplied with a display timing signal from the CRT controller 44 on line 51.

Accordingly, at the time the display timing signal is inputted, the AND circuit 67 produces the display character pattern information shifted out to the right from the bidirectional shift register 43 or that shifted out to the left from the same.

In this way, the display character pattern information outputted from the OR circuit 58 is supplied to the CRT 22 where it is displayed.

The programmable interface element (PIE) 61 is connected to one input terminal of the comparator 63 through line 62 and the comparator 63 is supplied at the other input with the refresh memory address from the CRT controller 44 on line 45.

Figure 5:
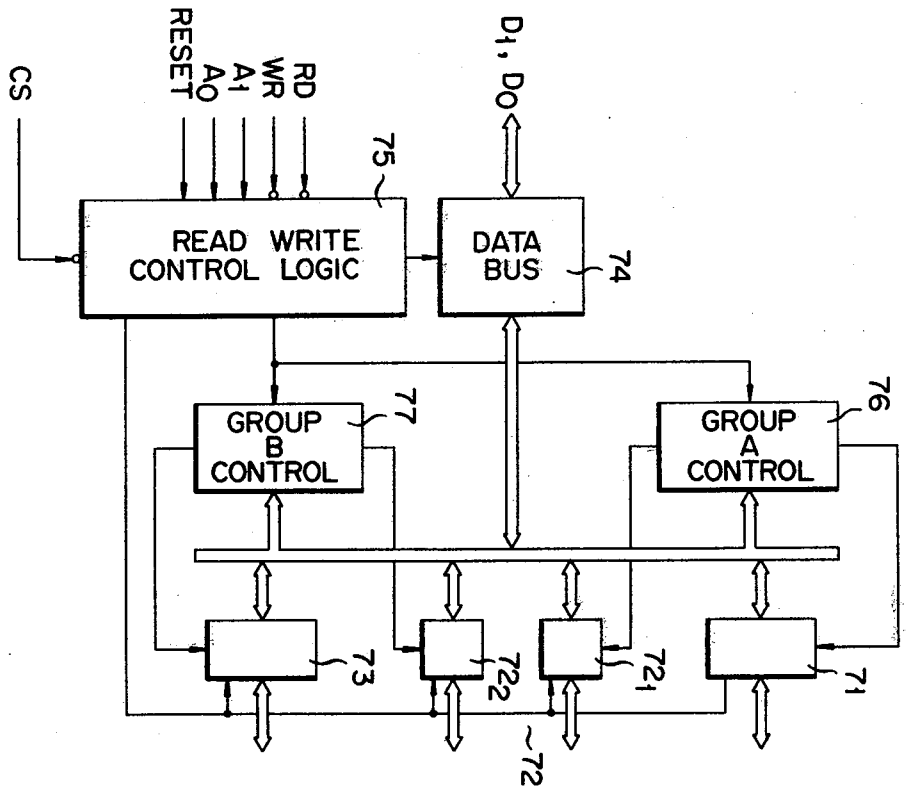
FIG. 5 is a block diagram of programmable interface shown in FIG. 4.

The programmable interface element (PIE) 61 performs an input/output interface function between the system bus 10 and related periphery equipment (not shown). The data may be programmably inputted and outputted to and from the PIE 61 which has buffers of 3 bytes therein. Those 3-byte buffers may be used corresponding to a cursor start raster address register, a cursor end raster address register, and a cursor register (H) or (L). The programmable interface has three ports 71 to 73, as shown in FIG. 5. Those ports 71 to 73 have functions which are programmably changeable. The port 71 has a single 8-bit data output latch/buffer and a single 8-bit data input latch. The port 72 has a single 8-bit data input, an output latch/buffer, and a single 8-bit input buffer. The port 73 has a single 8-bit data output latch/buffer, and a single 8-bit data input buffer (the input has no latch). The port 72 may be divided into ports $72_1$ and $72_2$ each of 4 bits by a mode control. Each 4-bit port is a 4-bit latch and is used for the output of the control signal or the input of the status information, in combination with the port 71 or the port 73. Further, included are a data buffer 74, a read/write control logic 75, and port control sections 76 and 77. Receiving the control word from an internal data bus (not shown) under control of a command from the read/write control logic 75, the port control sections 76 and 77 produce commands to the ports designated.

In the embodiment of the invention, the programmable interface is constituted by 8255A sold by Intel Co. and the operation and timing in each mode is described in "Intel 8080 Microcomputer System User's Manual" published by the same company in Sept., 1975.

The comparator 63 compares the refresh memory address from the CRT controller 44 with the contents of the cursor address set in the buffer in the programmable interface element 61 and applies an output as a corresponding cursor signal to the OR gate 58. The AND gate 67 is conditioned by the output from the OR gate 58 and the display timing through the line 51 from the CRT controller 44 and applies an output signal as a video signal to the CRT 22.

The output signal from the comparator 63 is coupled with the OR gate 58 through a control line 66. The output of the OR gate 58 is connected to one input terminal of an AND gate 67 of which the other input terminal is connected to the CRT controller 44 through a control line 51. The output of the AND gate 67 is connected to the CRT 22.

The CRT controller 44 includes a cursor start raster address register (not shown), a cursor end raster address register (not shown) and a cursor register (not shown), with rotation to the invention. The cursor start raster address and the cursor end raster address registers are for programming the end raster address of the cursor display and the start address of the cursor display, and the cursor register is for programming a current address to display the cursor. The cursor registers allows the read/write operation from the CPU 12. The cursor address programmed is compared with the internal address generated from an address generator (not shown) and a coincident signal is applied to the cursor control section (not shown). The cursor control section provides a cursor display signal which is a video signal for displaying a cursor on the CRT display screen. This signal is inhibited during a period of time that the display timing signal is a logical "0". Normally, the signal is mixed with the character video signal and supplied to the CRT display unit.

Figure 6:
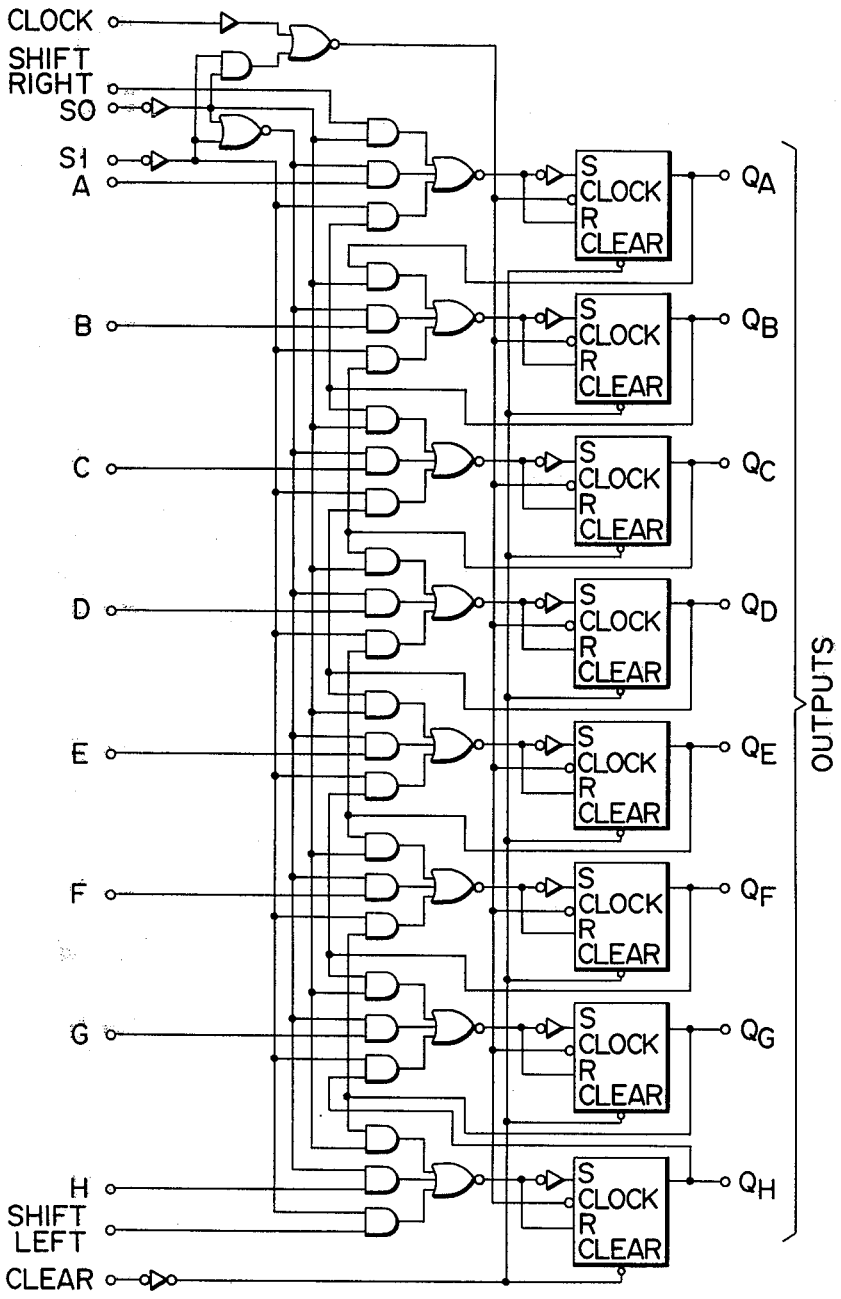
FIG. 6, including A–H, is a logic schematic diagram of the bidirectional shift register shown in FIG. 4.

FIG. 6 is a logic diagram of the bidirectional shift register 43 shown in FIG. 4. The embodiment employs an 8-bit parallel access right left shift register (SN74198 sold by Texas Instrument Co. in U.S.A. or the equivalent. The shift register has all the functions required for the shift register, and has a parallel input, a parallel output, a right shift input, a left shift input, an operation mode control input and a direct clear input. An operation mode control input (S1 or S0) enables the following modes to be selected:

(1) Parallel load
(2) Shift right
(3) Shift left
(4) Clock inhibition (no operation is made)

In the parallel load, the 8-bit data is applied to the inputs A to H and is stored in the respective floppy discs by clocking. In the shift right mode, the data is shifted to the right at the leading edge of the input clock pulse. At this time, the serial data is applied to the shift right terminal. In the shift left mode, the serial data applied to the shift left terminal is shifted to the left by the input clock pulse. In order to inhibit clocking of the flip-flop, logical "0"'s are applied to mode control inputs S0 and S1. The following table indicates the functions performed for the logical signals applied to mode control inputs S1 and S0.

TABLE 1

| Input | | |
|---|---|---|
| S1 | S0 | Operation Mode |
| 0 | 0 | Clock Inhibition |
| 0 | 1 | Shift right |
| 1 | 0 | Shift left |
| 1 | 1 | Parallel load |

For further details of the operation timing and the like of the SN74198 shift register, reference is made to "TTL Application Manual Data Book" published by Texas Instruments Co.

The operation of the system described above will now be explained.

Figure 7:
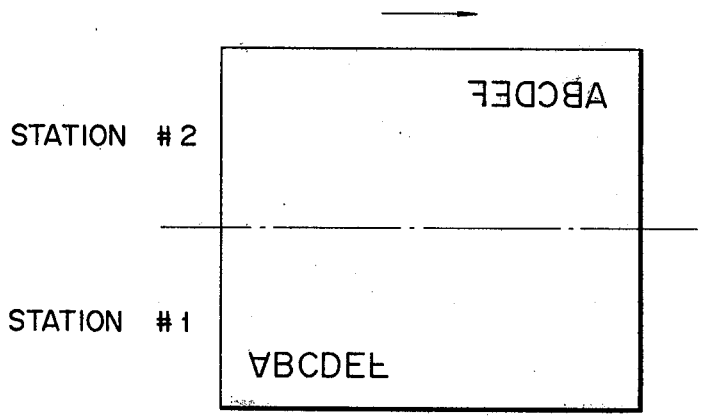
FIG. 7 shows formats of characters displayed on a display screen of the display system to which the invention is applied.

In the following description, the refresh memory address is a signal for dividing the CRT screen into two sections. The raster address outputted from the CRT controller 44 is representative of the number of rasters for each line. The signal outputted from the CRT controller 44 is a display permission signal (during a non-display period, the signal is a disable signal to inhibit the display). The formats of the characters displayed are as shown in FIGS. 3 and 7. In the case of the display data at station 1 shown in FIG. 3, the raster address supplied on line 46 from the multiplexer 55 is selected. In the case of displaying data at station 2, the multiplexer selects the output signal from the raster address conversion circuit 57 and inputted into the character generator 54 for display.

The CRT controller 44 produces the refresh memory address through the line 45. The refresh memory address is supplied through the multiplexer 47 to the refresh memory 52. The refresh memory 52 is supplied with the refresh memory address and produces encoded data from the location corresponding to the address. The encoded data is supplied to the character generator 54 which is also supplied with the raster address from the CRT controller 44, on bus line 46, the multiplexer 55 and the bus line 80, so that the composite information of the raster address information and the encoded data makes an access to the character generator 54. Upon receipt of the composite information, the character generator 54 produces pattern data from the address correponding to the address of the composite information. In response to a LOAD signal outputted from the dot counter 42, the bidirectional shift register 43 fetches the pattern data from the character generator 54. Since the bidirectional shift register 43 has been supplied with a logical "0" signal through the line 60, it supplies the display information to the station #1 24. Accordingly, the clock signal from the oscillator 41 causes the shift register 43 to shift the display information to the right and to produce the information in serial fashion. The display information outputted is supplied to the OR circuit 58. The cursor display signal is applied to the OR circuit on line 59. The OR circuit 58 applies the character pattern information shifted to the right or the left or the cursor display signal to the AND circuit 67. The AND circuit 67 produces the output signal from the OR circuit 58 to the CRT 22 on the basis of the display timing signal outputted on line 51 from the CRT controller 44.

On the other hand, the horizontal and the vertical synchronizing signals are supplied to the CRT 22 on lines 48 and 49 from the CRT controller 44 and necessary display information is displayed on the CRT 22 by the composite information with the output of the AND circuit 67. Through a repetition of the above-mentioned operations, one character is displayed on the CRT 22.

For displaying the display information on the station #2 25, the most significant bit of the refresh memory address outputted from the multiplexer 47 becomes a logical "1". As a result, the muliplexer 55 selects and produces the raster address information inverted from the raster address converting circuit 57 and not the address from the CRT controller 44. On the basis of the composite information of the inverted address information and the coded data information outputted from the refresh memory 52, the character generator 54 is accessed and the display information is produced from the memory location corresponding to the composite information. The bidirectional shift register 43 is supplied with a logical "1" signal on line 60. As a result, the shift register 43 shifts the display information outputted from the character generator 54 to the left. The shifted information is supplied to the CRT 22 through the OR circuit 58 and the AND circuit 67 to effect the display of the display information in the station #2 25.

For display of a cursor on one of the divided screens, a cursor display signal from the CRT controller 44 is assigned to one of the two picture screens and is supplied to the OR circuit 58 on line 59 where the cursor is displayed. For displaying another cursor on the other divided screen, cursor address information supplied through the system bus 10 from the CPU 12 is supplied to the register section within the programmable interface element 61. More specifically, the cursor address information stored in the register portion and the refresh address information outputted from the CRT controller 44 on bus line 45 are compared by the comparator 63 and when those are coincident with each other, the cursor display signal is supplied to the OR circuit 58. The cursor display signal is logically ANDed by the display timing signal by the AND circuit 67 and the logical product is supplied to the CRT 22.

In the above-mentioned embodiment, the programmable interface element is used to store the cursor display signal; however, a similar effect may be obtained by using the usual register. The CRT screen may be divided into three sections. In this case, the number of ports of the peripheral interfaces is increased correspondingly for controlling the cursor display.

As described above, in a display system of the type in which the screen of a raster scan type display is divided into a plurality of sections and the display information is supplied to the respective stations by using a mirror reflection, the cursor address on one station is set by using a register (in the above embodiment, a programmable interface) and a cursor position signal from the CRT controller is assigned to the other station, whereby cursors are displayed on the two stations.

With such a composition, the cost of the system is reduced, the number of parts mounted on the printed circuit board is reduced and thus the reliability of the system is improved.

What is claimed is:

1. A cursor display control system for a raster scan type display system which divides a raster scan type display screen and provides the display information to the respective divided sides by using a mirror reflection comprising;

a display unit for displaying dot data in a raster scan manner;

a programmable CRT controller for interfacing the display unit of the raster scan type and for producing a refresh memory address, a raster address and timing signal for displaying data on the display screen in order that the screen can be programmably set;

a refresh memory for storing coded data to be displayed in response to the refresh memory address obtained from the controller;

raster address converting circuit means which receives the raster address obtained from the controller and converts the raster address to a converted raster address;

multiplexer means for selectively outputting the raster address from the controller and the converted raster address from the raster address converting circuit means on the basis of control information contained in the refresh memory address;

a character generator for converting the coded data inputted from the refresh memory into display pattern data on the basis of raster address information obtained from the multiplexer means;

bidirectional shift register means which receives the pattern information from the character generator, determines the shift direction on the basis of the control information contained in the refresh memory address, and produces serial dot data to the display unit;

cursor address information storing means for storing cursor address information supplied from a central processing element through a system bus;

comparing means which compares the cursor address information outputted from the cursor address information storage means with the refresh memory address outputted from the programmable CRT controller and produces a cursor display signal when both the cursor address information and the refresh memory address are coincident with each other.

2. A cursor display system for a raster scan type display system according to claim 1, wherein the multiplexer means selects and produces the raster address so that the pattern information is supplied to one side of the divided screen to be displayed when the control information has one value, and selects and produces the converted raster address so that the pattern information is supplied to the other side of the divided screen to be displayed when the control information has the other value.

3. A cursor display system for a raster scan type display system according to claim 1, wherein the bidirectional shift register means shifts the pattern information to one direction and produces it in serial fashion so that the pattern information is supplied to one side of the divided screen to be displayed when the control information has one value, and shifts the pattern information to the other direction and produces it in serial fashion so that the pattern information is supplied to the other side of the divided screen to be displayed when the control information has the other value.

4. A cursor display system for a raster scan type display system which divides a raster scan type display screen and provides the display information to the respective divided sides by using a mirror reflection comprising;

a display unit for displaying dot data in a raster scan manner;

an oscillating circuit for producing a reference clock signal;

a programmable CRT controller for interfacing the display unit of the raster scan type and for producing a refresh memory address, a raster address and a timing signal for displaying data on the display screen in order that the screen can be programmably set;

a refresh memory for storing coded data to be displayed in response to a refresh memory address obtained from the controller;

first multiplexer means which receives the refresh memory address obtained from the programmable controller, a read-out address for reading the refresh memory address outputted from the programmable controller and a write address for writing the coded data into said refresh memory outputted from a central processing unit through an internal bus, and selectively outputs address information on the basis of the timing signal supplied from the programmable controller;

raster address converting circuit means which receives the raster address obtained from the controller and converts the raster address to a converted raster address;

second multiplexer means for selectively outputting the raster address from the controller and the converted raster address from the raster address converting circuit means on the basis of control information contained in the refresh memory address outputted from the first multiplexer means;

a character generator for converting the coded data inputted from the refresh memory into display pattern data on the basis of the raster address information obtained from the second multiplexer means;

bidirectional shift register means which receives the pattern information from the character generator, determines the shift direction on the basis of the control information contained in the refresh memory address, and produces serial dot data which is coupled to said display unit;

cursor address information storing means for storing cursor address information supplied from a central processing element through a system bus;

comparing means which compares the cursor address information outputted from the cursor address information storage means with the refresh memory address outputted from said programmable CRT controller and produces a cursor display signal when both the cursor address information and the refresh memory address are coincident with each other.

5. A cursor display system for a raster scan type display system according to claim 4, wherein the control information contained in the refresh memory address supplied from the first multiplexer means to the second multiplexer means and to the bidirectional shift register is any one bit of the refresh memory address outputted from the first multiplexer means.

6. A cursor display system for a raster scan type display system according to claim 4, wherein the second multiplexer means selects and produces the raster address so that the pattern information is supplied to one side of the divided screen to be displayed when the control information has one value, and selects and produces the converted raster address so that the pattern information is supplied to the other side of the divided screen to be displayed when the control information has the other value.

7. A cursor display system for a raster scan type display system according to claim 4, wherein the bidirectional shift register means shifts the pattern information to one direction and produces it in serial fashion so that the pattern information is supplied to one side of the divided screen to be displayed when the control information has one value, and shifts the pattern information to the other direction and produces it in serial fashion so that the pattern information is supplied to the other side of the divided screen to be displayed when the control information has the other value.

* * * * *

UNITED STATES PATENT AND TRADEMARK OFFICE

CERTIFICATE OF CORRECTION

PATENT NO. : 4,323,891

DATED : 4/6/82

INVENTOR(S) : Kazuo Akashi

It is certified that error appears in the above—identified patent and that said Letters Patent is hereby corrected as shown below:

Col. 1, line 19
change "system" (second occurrence) to --systems--

Col. 1, line 21
after "two" change "screen" to --screens--

Col. 1, line 32
change "costs" to -- cost--

Col. 1, line 61
after "information" insert --contained in--

Col. 2, line 5
after "storing" (2nd occurrence) insert --the--

Col. 2, line 13
before "information" insert --cursor address--

Col. 2, line 23
after "two" change "screens" to --screen--

UNITED STATES PATENT AND TRADEMARK OFFICE

CERTIFICATE OF CORRECTION

PATENT NO. : 4,323,891

DATED : 4/6/82

INVENTOR(S) : Kazuo Akashi

It is certified that error appears in the above—identified patent and that said Letters Patent is hereby corrected as shown below:

Col. 2, line 30
after "of" insert --the--

Col. 2, line 33, delete "including A-H"

Col. 3, line 51
after "49" change "to" to --for--

Col. 3, line 51
after "transmission" change "for" to --to--

Col. 5, line 57
after "with" change "rotation" to --relation--

Col. 5, line 62
change "registers" to --register--

Col. 6, line 10
after "lent" insert --)--

UNITED STATES PATENT AND TRADEMARK OFFICE

CERTIFICATE OF CORRECTION

PATENT NO. : 4,323,891

DATED : 4/6/82

INVENTOR(S) : Kazuo Akashi

It is certified that error appears in the above—identified patent and that said Letters Patent is hereby corrected as shown below:

Col. 6, line 60
after "and" change "inputted" to --inputs it--

Col. 7, line 8
change "correponding" to --corresponding--

Col. 8, line 19
change "composition" to - construction--

Col. 8, line 34
after "and" insert --a--

Signed and Sealed this

*Twenty-second* Day of *June 1982*

[SEAL]

*Attest:*

GERALD J. MOSSINGHOFF

*Attesting Officer*

*Commissioner of Patents and Trademarks*